US008863359B1

(12) United States Patent
Krajenke et al.

(10) Patent No.: US 8,863,359 B1
(45) Date of Patent: Oct. 21, 2014

(54) VEHICLE AND A HINGE ASSEMBLY FOR A STORAGE COMPARTMENT OF THE VEHICLE

(71) Applicant: GM Global Technology Operations LLC, Detroit, MI (US)

(72) Inventors: Gary W. Krajenke, Warren, MI (US); Himanshu H. Mehta, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 11 days.

(21) Appl. No.: 13/859,001

(22) Filed: Apr. 9, 2013

(51) Int. Cl.
*E05F 1/08* (2006.01)

(52) U.S. Cl.
USPC ..... 16/289; 16/308; 16/286; 296/76; 296/146.11; 296/146.8

(58) Field of Classification Search
CPC ..... E05Y 2900/548; E05Y 2900/546; E05Y 2900/531; E05Y 2201/416; E05D 2005/067; E05F 1/1276; E05F 1/1284; E05F 1/1292; E05F 1/1033; E05F 5/022
USPC ..... 16/289, 286, 368, 366, 311, 369, 370, 16/287, 288, 277, 308, 306; 296/76, 296/146.11, 146.8
See application file for complete search history.

(56) References Cited

U.S. PATENT DOCUMENTS

| | | | | |
|---|---|---|---|---|
| 2,594,643 | A * | 4/1952 | Gustisha | 296/76 |
| 3,621,509 | A * | 11/1971 | Bugnell | 16/289 |
| 5,235,725 | A * | 8/1993 | Rees | 16/298 |
| 6,454,339 | B2 * | 9/2002 | Wilde et al. | 296/76 |
| 6,637,797 | B2 * | 10/2003 | Baik | 296/76 |
| 8,251,431 | B2 * | 8/2012 | Nakazato | 296/76 |
| 2002/0096905 | A1 * | 7/2002 | Nicholas et al. | 296/76 |
| 2006/0230578 | A1 * | 10/2006 | Renke et al. | 16/289 |
| 2013/0119698 | A1 * | 5/2013 | Patzer et al. | 296/146.12 |
| 2013/0318745 | A1 * | 12/2013 | Krajenke et al. | 16/305 |

FOREIGN PATENT DOCUMENTS

| | | | |
|---|---|---|---|
| GB | 1359340 | A * | 7/1974 |
| JP | 10236337 | A * | 9/1998 |

* cited by examiner

*Primary Examiner* — Chuck Mah
(74) *Attorney, Agent, or Firm* — Quinn Law Group, PLLC

(57) ABSTRACT

A vehicle and a hinge assembly for a storage compartment of the vehicle are disclosed. The assembly includes a first component adapted to be attached to the vehicle and a second component. The second component includes a first end portion coupled to the first component and a second end portion spaced from the first end portion. The second component is movable relative to the first component between a first position and a second position such that the second end portion is disposed above the first component when in the second position. The assembly further includes a link coupled to the second component and movable with the second component as the second component moves between the first and second positions. The link extends away from the second component to a distal end. The assembly includes a guard attached to the link and covering at least a portion of the distal end.

20 Claims, 3 Drawing Sheets

VEHICLE AND A HINGE ASSEMBLY FOR A STORAGE COMPARTMENT OF THE VEHICLE

TECHNICAL FIELD

The present disclosure relates to a vehicle and a hinge assembly for a storage compartment of the vehicle.

BACKGROUND

Various vehicles include a trunk for storing items. Generally, the trunk opens and closes on a hinge device. Sometimes, the hinge device can engage the items in the trunk when, for example, the trunk is closed.

SUMMARY

The present disclosure provides a hinge assembly for a storage compartment of a vehicle. The hinge assembly includes a first component adapted to be attached to the vehicle and a second component. The second component includes a first end portion coupled to the first component and a second end portion spaced from the first end portion. The second component is movable relative to the first component between a first position and a second position such that the second end portion is disposed above the first component when in the second position. The hinge assembly further includes a link coupled to the second component and movable with the second component as the second component moves between the first and second positions. The link extends away from the second component to a distal end. The hinge assembly also includes a guard attached to the link and covering at least a portion of the distal end.

The present disclosure also provides a vehicle including a storage compartment. The storage compartment includes a mounting shelf and a trunk lid movable relative to the mounting shelf to open and close the storage compartment. The vehicle also includes a hinge assembly coupled to the mounting shelf and the trunk lid for supporting the trunk lid when opening and closing the storage compartment. The hinge assembly includes a first component attached to the mounting shelf. The hinge assembly also includes a second component coupled to the first component and attached to the trunk lid, with the second component movable relative to the first component. The hinge assembly further includes a link movably coupled to the second component and extending away from the second component to a distal end. The hinge assembly further includes a guard attached to the link and covering at least a portion of the distal end.

Therefore, the guard prevents objects or items from directly engaging the portion of the distal end. As such, the guard protects the objects or items from the portion of the distal end.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Figure 1:
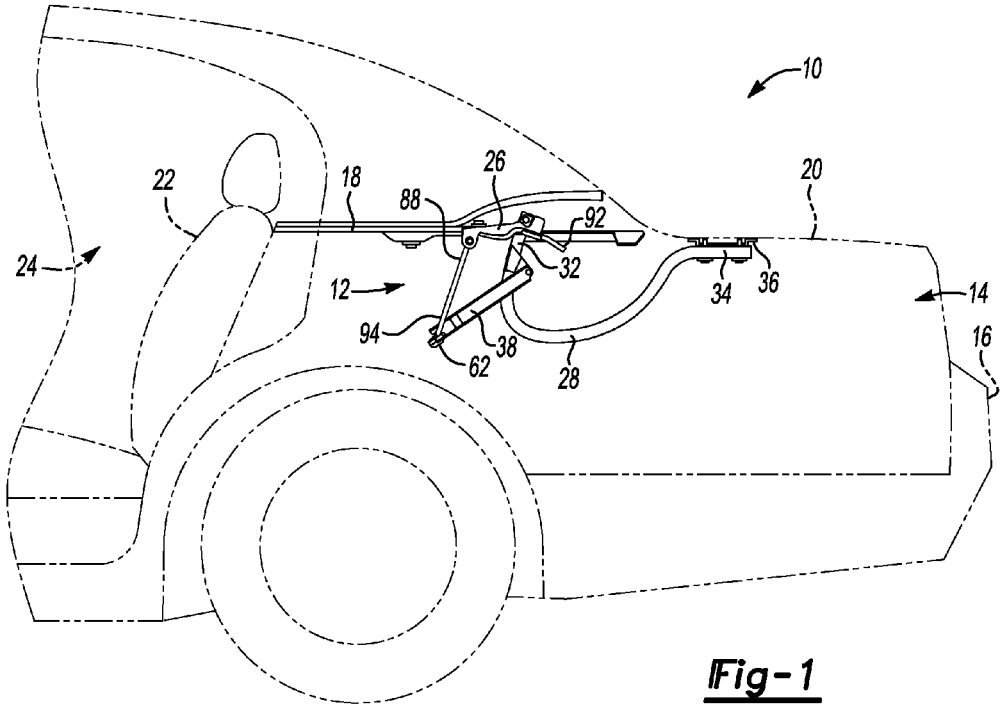
FIG. 1 is a schematic broken partially phantom side view of a vehicle illustrating a hinge assembly inside a storage compartment, with the storage compartment closed and a second component in a first position.
Figure 2:
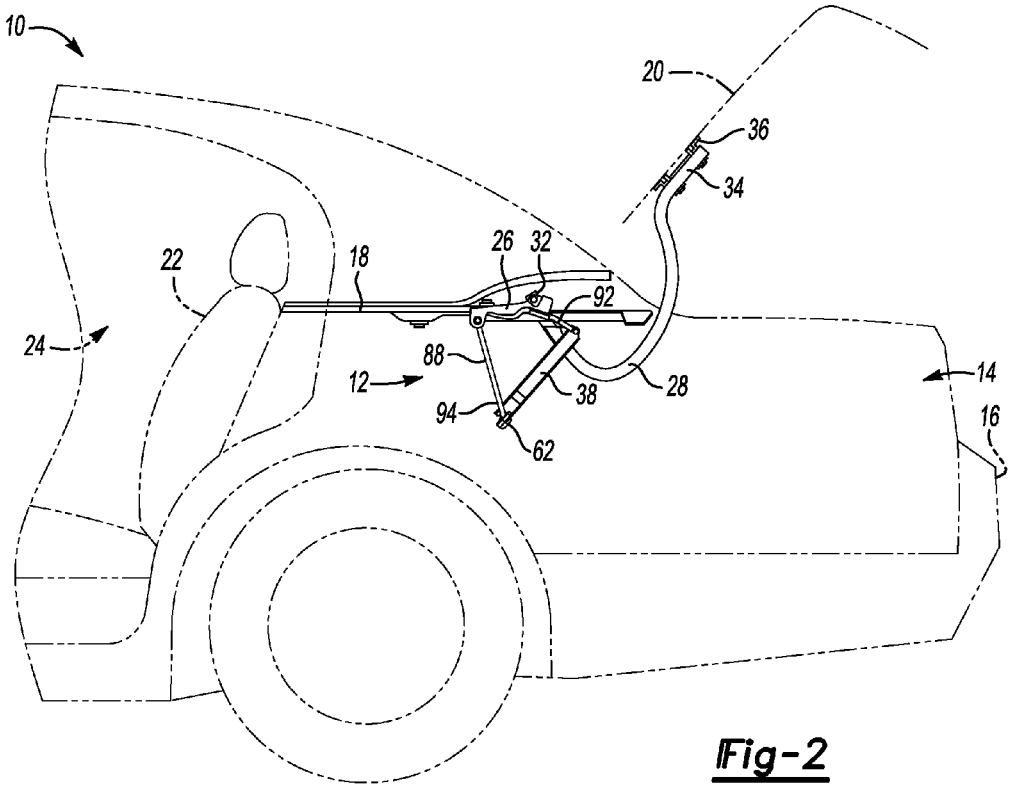
FIG. 2 is a schematic broken partially phantom side view of the vehicle illustrating the trunk lid up to open the storage compartment and the second component in a second position.

Referring to the Figures, wherein like numerals indicate like or corresponding parts throughout the several views, a vehicle 10 and a hinge assembly 12 for a storage compartment 14 of the vehicle 10 are generally shown in FIGS. 1 and 2. Generally, the vehicle 10 includes the hinge assembly 12. The hinge assembly 12 can be useful for vehicles 10, such as automotive vehicles. It is to be appreciated that the hinge assembly 12 can also be useful for non-automotive applications including, for example, marine or aviation applications, etc.

As shown in FIGS. 1 and 2, the vehicle 10 can include the storage compartment 14. For example, a user can store objects, items, etc. in the storage compartment 14. Generally, in one vehicle application, the storage compartment 14 is disposed toward a rear 16 of the vehicle 10. It is to be appreciated that the storage compartment 14 can be located at the front of the vehicle 10 or any other suitable location. Furthermore, it is to be appreciated that the hinge assembly 12 can be utilized for a hood of the vehicle 10 or any other suitable features of the vehicle 10.

Continuing with FIGS. 1 and 2, the storage compartment 14 can include a mounting shelf 18 and a trunk lid 20 movable relative to the mounting shelf 18 to open and close the storage compartment 14. For example, the mounting shelf 18 can be disposed behind the rear passenger seats 22 as shown in FIGS. 1 and 2. As such, the mounting shelf 18 cooperates with a passenger compartment 24 of the vehicle 10 and the storage compartment 14. The mounting shelf 18 can also be referred to as a packaging shelf. It is to be appreciated that the storage compartment 14 can include other features such as side walls cooperating with the mounting shelf 18 and the trunk lid 20 to further define the storage compartment 14.

Generally, the hinge assembly 12 is disposed inside the storage compartment 14. Therefore, when the storage compartment 14 is closed, the hinge assembly 12 is not visible from the outside of the vehicle 10. The hinge assembly 12 is coupled to the mounting shelf 18 and the trunk lid 20 for supporting the trunk lid 20 when opening and closing the storage compartment 14. Simply stated, the hinge assembly 12 is utilized to move the trunk lid 20 back and forth to open and close the storage compartment 14. FIG. 1 illustrates the trunk lid 20 down such that the storage compartment 14 is closed and FIG. 2 illustrates the trunk lid 20 up such that the storage compartment 14 is opened.

As best shown in FIGS. 1 and 2, a segment of the hinge assembly 12 is attached to the mounting shelf 18 and another segment of the hinge assembly 12 is attached to the trunk lid 20 as further discussed below. It is to be appreciated that a plurality of hinge assemblies 12 can be utilized in the vehicle 10. For example, one hinge assembly 12 can be attached adjacent to one side edge of the trunk lid 20 and the mounting shelf 18, and similarly, another hinge assembly 12 can be attached adjacent to another side edge of the trunk lid 20 and the mounting shelf 18.

Figure 3:
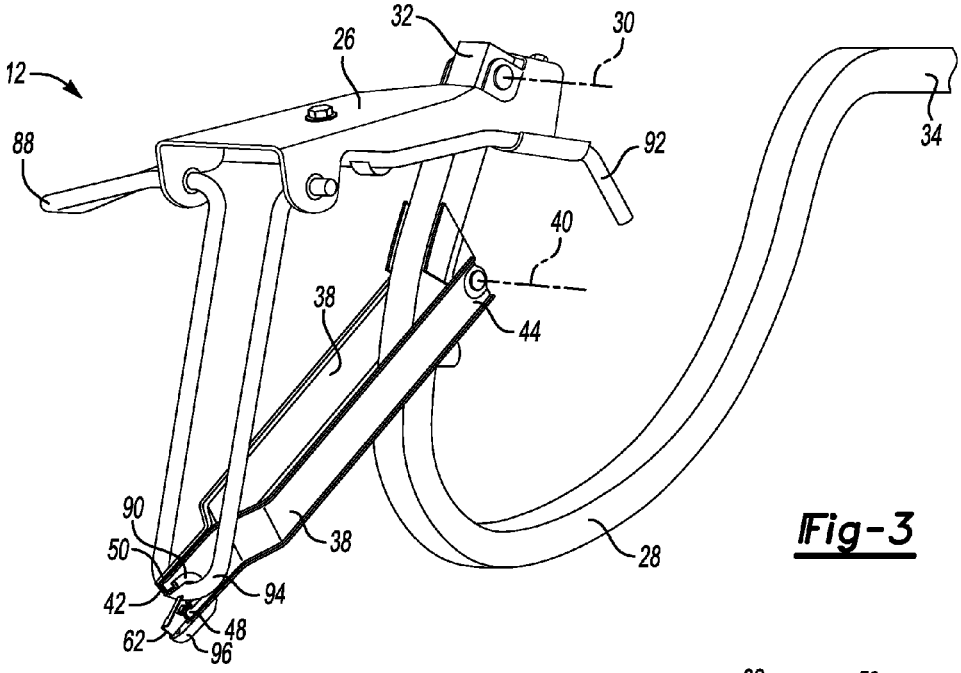
FIG. 3 is a schematic perspective view of the hinge assembly.

Also referring to FIG. 3, the hinge assembly 12 includes a first component 26 and a second component 28 coupled to the first component 26. Generally, the first component 26 is adapted to be attached to the vehicle 10. More specifically, in certain embodiments, the first component 26 is attached to the mounting shelf 18 (the first component 26 can be one segment of the hinge assembly 12 as mentioned above) and the second component 28 is attached to the trunk lid 20 (the second component 28 can be another segment of the hinge assembly 12 as mentioned above). Therefore, the first component 26 is coupled or attached to the mounting shelf 18 such that the first component 26 is not visible from inside of the passenger compartment 24. Similarly, the second component 28 is coupled or attached to the trunk lid 20 such that the second component 28 is not visible from outside of the vehicle 10 when the storage compartment 14 is closed.

Generally, the second component 28 is movable relative to the first component 26. Specifically, the second component 28 is movable relative to the first component 26 between a first position and a second position. In certain embodiments, the second component 28 can be rotatable about a pivot axis 30 between the first and second positions. As such, the second component 28 is coupled to the first component 26 at the pivot axis 30, with the second component 28 rotatable between the first and second positions relative to the first component 26. FIG. 1 illustrates the second component 28 in the first position and FIG. 2 illustrates the second component 28 in the second position. The first component 26 can be further defined as a mounting bracket, with the mounting bracket attached to the mounting shelf 18. The second component 28 can be further defined as a rod. Additionally, the second component 28 can be referred to as a goose neck strap.

Referring to FIGS. 1-3, the second component 28 includes a first end portion 32 coupled to the first component 26. Additionally, the second component 28 includes a second end portion 34 spaced from the first end portion 32. Generally, the second end portion 34 is attached to the trunk lid 20. For example, the second end portion 34 is attached to an inside 36 of the trunk lid 20 as shown in FIGS. 1 and 2. The second component 28 is movable between the first and second positions such that the second end portion 34 is disposed above the first component 26 when in the second position. Therefore, for example, when the trunk lid 20 is up, as shown in FIG. 2, the second end portion 34 of the second component 28 is disposed above the first component 26.

Figure 4:
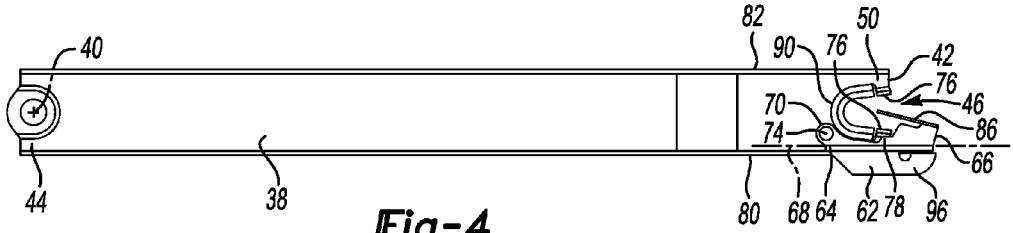
FIG. 4 is a schematic side view of a link and a guard covering a distal end of the link.

As best shown in FIGS. 3 and 4, the hinge assembly 12 also includes a link 38 coupled to the second component 28 and movable with the second component 28 as the second component 28 moves between the first and second positions. As such, the link 38 is movably coupled to the second component 28. In certain embodiments, the link 38 is rotatable about a first axis 40 substantially parallel to the pivot axis 30 as the second component 28 rotates about the pivot axis 30. Specifically, the link 38 can be coupled to the second component 28 between the first and second end portions 32, 34. As the trunk lid 20 opens or closes, the second component 28 rotates about the pivot axis 30 and concurrently, the link 38 moves with the second component 28 about the pivot axis 30 while also rotating about the first axis 40 (compare FIGS. 1 and 2). It is to be appreciated that the link 38 can be formed of one or more pieces.

Generally, the link 38 extends away from the second component 28 to a distal end 42. As such, the link 38 can include an attachment end 44 spaced from the distal end 42, with the attachment end 44 coupled to the second component 28. Therefore, the first axis 40 is disposed through the attachment end 44 of the link 38. It is to be appreciated that the link 38 can be coupled to the second component 28 by any suitable fasteners, methods, etc. It is to also be appreciated that the link 38 can be coupled to the second component 28 in any suitable location.

Figure 5:
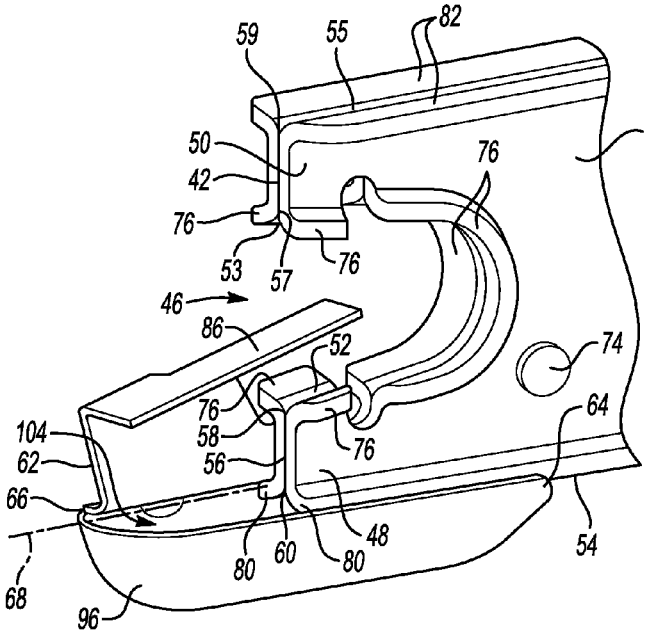
FIG. 5 is a schematic perspective view of the link and the guard, with a cap portion of the guard in an initial position.
Figure 6:
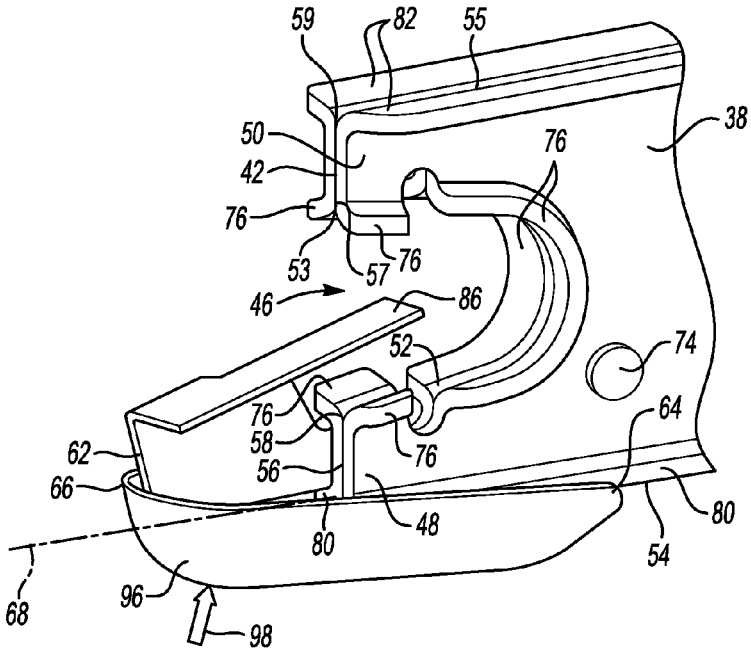
FIG. 6 is a schematic perspective view of the link and the guard, with the cap portion of the guard in a displaced position.

As best shown in FIGS. 4-6, in certain embodiments, the distal end 42 of the link 38 defines a recess 46 such that the distal end 42 presents a first leg 48 and a second leg 50 spaced from each other. More specifically, the recess 46 extends toward the first axis 40 such that the distal end 42 presents the first and second legs 48, 50 spaced from each other. It is to be appreciated that the first and second legs 48, 50 can be any suitable configuration.

For example, the first leg 48 can include a first side 52 facing the recess 46 and a second side 54 opposing the first side 52. Furthermore, the first leg 48 can include a base 56 facing away from the second component 28 and disposed between the first and second sides 52, 54 such that the base 56 and the first side 52 present a first junction 58 and the base 56 and the second side 54 present a second junction 60. The second leg 50 can be a mirror image of the first leg 48, and therefore, include opposing first and second sides 53, 55 and first and second junctions 57, 59 as described in detail for the first leg 48. As such, the second leg 50 will not be discussed in detail. It is to be appreciated that the first and second legs 48, 50 can be different configurations from each other.

Continuing with FIGS. 4-6, the hinge assembly 12 further includes a guard 62 attached to the link 38. Generally, the guard 62 covers at least a portion of the distal end 42. For example, the portion of the distal end 42 can include one of the first and second legs 48, 50. As such, the guard 62 can cover at least a portion of one of the first and second legs 48, 50. In one embodiment, the guard 62 covers at least a portion of the first leg 48. More specifically, in certain embodiments, the guard 62 covers the second side 54 of the first leg 48. Specifically, in one embodiment, the guard 62 covers the second junction 60 of the first leg 48. It is to be appreciated that any suitable portion of one of the first and second legs 48, 50 can be covered by the guard 62, such as, for example, a small portion of one of the first and second legs 48, 50 can be covered by the guard 62, a large or substantial portion of one of the first and second legs 48, 50 can be covered by the guard 62, the entire one of the legs 48, 50 can be covered by the guard 62, etc.

Furthermore, as best shown in FIGS. 4 and 5, the guard 62 can include a first end 64 and a second end 66 spaced from each other along a longitudinal axis 68. Generally, the first end 64 can be attached to the link 38 and the second end 66 extends beyond the first leg 48. More specifically, the guard 62 can include an arm 70 extending outwardly from the first end 64 to attach the guard 62 to the link 38. In other words, the arm 70 can be attached to the link 38, and therefore, the arm 70 secures the guard 62 to the link 38. In certain embodiments, the guard 62 can include a main body 72, with the arm 70 extending from the main body 72.

As best shown in FIGS. 4-6, a pin 74 can be disposed through the arm 70 and the link 38 to secure together the guard 62 and the link 38. Generally, the guard 62 does not pivot about the pin 74. For example, as best shown in FIG. 4, the link 38 can include a first flange 76 and the guard 62 can include a shoulder 78 engaging the first flange 76 to substantially prevent rotation of the guard 62 about the pin 74. It is to be appreciated that the guard 62 can be designed to slightly pivot about the pin 74.

Continuing with FIGS. 4-6, the first flange 76 can extend outwardly away from one of the first sides 52, 53 of the first and second legs 48, 50. For example, in certain embodiments, the first flange 76 extends outwardly away from the first side 52 of the first leg 48. Specifically, the first flange 76 can extend from both of the first sides 52, 53 of the first and second legs 48, 50 and around the recess 46 adjacent to the first sides 52, 53. Therefore, the first flange 76 can extend outwardly away from the recess 46 transverse to the longitudinal axis 68. Furthermore, the link 38 can include a second flange 80 spaced from the first flange 76. The second flange 80 can extend outwardly away from one of the second sides 54, 55 of the first and second legs 48, 50. For example, in certain embodiments, the second flange 80 extends outwardly away from the second side 54 of the first leg 48. Specifically, the second flange 80 can extend outwardly away from the second side 54 of the first leg 48 transverse to the longitudinal axis 68. Generally, the second flange 80 of the first leg 48 is at least partially covered by the guard 62. Additionally, the link 38 can include a third flange 82 spaced from the first and second flanges 76, 80. The third flange 82 can extend outwardly away from one of the second sides 54, 55 of the first and second legs 48, 50. For example, in certain embodiments, the third flange 82 extends outwardly away from the second side 55 of the second leg 50. Specifically, the third flange 83 can extend outwardly away from the second side 55 of the second leg 50 transverse of the longitudinal axis 68. In certain embodiments, the second and third flanges 80, 82 are substantially parallel to each other. It is to be appreciated that the first, second and third flanges 76, 80, 82 can be any suitable configuration and are optional.

Turning to FIGS. 3, 5 and 6, the guard 62 can include a tab 86 extending outwardly from the second end 66 and into the recess 46. More specifically, the tab 86 of the guard 62 extends into the recess 46 between the first and second legs 48, 50. Specifically, the tab 86 extends from the second end 66 back toward the first end 64 and is spaced from the arm 70. Generally, the tab 86 is biasable between the first and second legs 48, 50, which will be discussed further below.

The hinge assembly 12 can also include a biasing member 88 coupled to the first component 26 and disposed in the recess 46 of the link 38 to continuously bias the second component 28 to the second position. Therefore, when a latch disengages from the trunk lid 20, the trunk lid 20 can rotate about the pivot axis 30 by the biasing member 88 biasing the trunk lid 20 up to open the storage compartment 14. Optionally, as shown in FIGS. 3 and 4, a sleeve 90 can be attached to the first and second legs 48, 50 inside the recess 46 such that the biasing member 88 engages the sleeve 90 when the biasing member 88 is disposed in the recess 46. It is to be appreciated that the sleeve 90 can engage or be attached to the first flange 76 when utilized. As shown in FIGS. 5 and 6, the sleeve 90 has been removed.

The hinge assembly 12 is manufactured and assembled before being attached or mounted in the storage compartment 14. Therefore, the biasing member 88 and the link 38 have to be attached to each other before being inserted into the storage compartment 14. Therefore, to assemble the hinge assembly 12, the biasing member 88 and the tab 86 engage each other for securing the biasing member 88 in the recess 46. For example, the biasing member 88 engages one of the legs 48, 50 and the tab 86 when the biasing member 88 begins to be inserted into the recess 46 such that the tab 86 biases toward the other one of the legs 48, 50. When the biasing member 88 passes the tab 86, the tab 86 biases back over the biasing member 88 such that the biasing member 88 is secured in the recess 46. Once the biasing member 88 is secured in the recess 46, the hinge assembly 12 can be mounted in the storage compartment 14. In other words, when the biasing member 88 is secured in the recess 46 of the link 38, the hinge assembly 12 can then be attached to the mounting shelf 18 and the trunk lid 20. In certain embodiments, the biasing member 88 is further defined as a torsion rod including a first part 92 attached to the first component 26 and a second part 94 secured in the recess 46 by the tab 86 (see FIGS. 1 and 2).

As best shown in FIGS. 4-7, additionally, the guard 62 can include a cap portion 96 extending outwardly from the main body 72 to cover at least a portion of the first leg 48. The cap portion 96 can be biasable relative to the main body 72 when a force 98 (see FIG. 6) is applied to the cap portion 96. Therefore, for example, when the trunk lid 20 is being closed, the link 38 can rotate toward any items or objects in the storage compartment 14 and the guard 62 can engage one or more of those items or objects. When the guard 62 comes into contact with the item or object, the cap portion 96 prevents direct engagement of the item/object with the leg 48, 50 that the guard 62 covers. As such, the guard 62 protects the items/objects in the storage compartment 14 from engagement with one of the first and second junctions 57, 58, 59, 60.

In addition, the cap portion 96 is biasable independently of the tab 86. In other words, biasing of the tab 86 does not cause biasing of the cap portion 96. Similarly, biasing of the cap portion 96 does not cause biasing of the tab 86. FIGS. 1-5 and 7 illustrate the cap portion 96 in an initial position without applying the force 98 to the guard 62 and FIG. 6 illustrates the cap portion 96 in a displaced position having the force 98 applied to the guard 62 and being biased. It is to be appreciated that the cap portion 96 can bias differently than illustrated in FIG. 6. In addition, it is to be appreciated that the force 98 applied to the guard 62 could be small such that the cap portion 96 does not bias. As also shown in FIG. 6, when the force 98 is applied, the cap portion 62 can bias such that the cap portion 62 overlaps a portion of the main body 72 transverse to the longitudinal axis 68. In other words, a portion of the main body 72 can be disposed in the cap portion 62.

Figure 7:
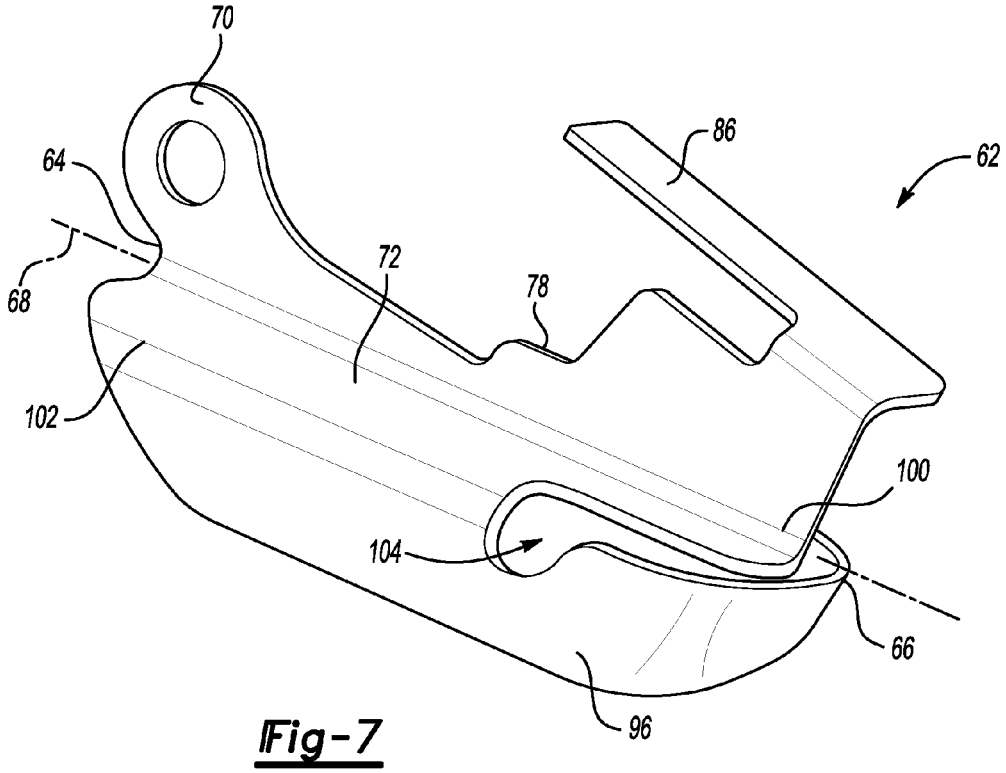
FIG. 7 is a schematic perspective view of the guard.

Turning to FIGS. 5-7, furthermore, the main body 72 can include a first edge 100 and a second edge 102 spaced from each other. More specifically, the first and second edges 100, 102 can be spaced from each other transverse to the longitudinal axis 68. For example, as best shown in FIG. 7, the arm 70 can extend from the first edge 100 and the cap portion 96 can extend from the second edge 102. Specifically, the cap portion 96 extends from the second edge 102 back around toward the first edge 100 such that the main body 72 and the cap portion 96 define a pocket 104 therebetween for receiving the first leg 48. Said differently, the cap portion 96 extends from the second edge 102 back around toward the first edge 100 to define an arcuate configuration. When the force 98 is applied, the cap portion 62 can bias such that a portion of the main body 72 can be disposed in the pocket 104 (see FIG. 6). The arcuate configuration provides a friendly surface for engagement with the items/objects in the storage compartment 14. In one embodiment, generally the second junction 60 is disposed in the pocket 104 (see FIGS. 5 and 6).

The guard 62 can be formed of a metal material having elastic properties. More specifically, the metal material is steel, such as spring steel. In other words, the guard 62 is formed of a biasable material such that the tab 86 and the cap portion 96 are elastically deformable when being engaged. Therefore, the tab 86 and the cap portion 96 can flex or bend when being engaged. Simply stated, the tab 86 and the cap portion 96 can bias to spring back to their original configuration when disengaged. It is to be appreciated that the guard 62 can be formed of any suitable material having elastic properties. Furthermore, it is to be appreciated that the guard 62 can be formed of one-piece or integrally formed as a unitary component. Alternatively, one or more of the features of the guard 62 can be formed of multiple pieces.

While the best modes for carrying out the disclosure have been described in detail, those familiar with the art to which this disclosure relates will recognize various alternative designs and embodiments for practicing the disclosure within the scope of the appended claims.

The invention claimed is:

1. A hinge assembly for a storage compartment of a vehicle, the assembly comprising:

a first component adapted to be attached to the vehicle;

a second component including a first end portion coupled to the first component and a second end portion spaced from the first end portion, with the second component hingeable relative to the first component between a first position and a second position such that the second end portion is disposed above the first component when in the second position;

a link coupled to the second component and movable with the second component as the second component moves between the first and second positions, with the link extending away from the second component to a distal end; and a guard attached to the link and covering at least a portion of the distal end.

2. An assembly as set forth in claim 1 wherein the distal end of the link defines a recess such that the distal end presents a first leg and a second leg spaced from each other, with the guard covering at least a portion of one of the first and second legs.

3. An assembly as set forth in claim 2 wherein the guard covers at least a portion of the first leg.

4. An assembly as set forth in claim 3 wherein the first leg includes a first side facing the recess and a second side opposing the first side, with the guard covering the second side of the first leg.

5. An assembly as set forth in claim 4 wherein the first leg includes a base facing away from the second component and disposed between the first and second sides such that the base and the first side present a first junction and the base and the second side present a second junction, with the guard covering the second junction.

6. An assembly as set forth in claim 1 wherein the second component is rotatable about a pivot axis between the first and second positions, and wherein the link is rotatable about a first axis substantially parallel to the pivot axis as the second component rotates about the pivot axis, and wherein the distal end of the link defines a recess extending toward the first axis such that the distal end presents a first leg and a second leg spaced from each other, with the guard covering at least a portion of one of the first and second legs.

7. An assembly as set forth in claim 6 wherein the guard covers at least a portion of the first leg.

8. An assembly as set forth in claim 7 wherein the guard includes a first end and a second end spaced from each other along a longitudinal axis, with the first end attached to the link and the second end extending beyond the first leg.

9. An assembly as set forth in claim 8 wherein the guard includes an arm extending outwardly from the first end to attach the guard to the link.

10. An assembly as set forth in claim 8 wherein the guard includes a tab extending outwardly from the second end and into the recess, with the tab biasable between the first and second legs.

11. An assembly as set forth in claim 1 wherein the guard includes a main body and an arm extending from the main body, with the arm attached to the link.

12. An assembly as set forth in claim 11 wherein the distal end of the link defines a recess such that the distal end presents a first leg and a second leg spaced from each other, with the guard covering at least a portion of the first leg.

13. An assembly as set forth in claim 12 wherein the guard includes a cap portion extending outwardly from the main body to cover at least a portion of the first leg.

14. An assembly as set forth in claim 13, wherein the cap portion is biasable relative to the main body when a force is applied to the cap portion.

15. An assembly as set forth in claim 13 wherein the main body includes a first edge and a second edge spaced from each other, with the arm extending from the first edge, and with the cap portion extending from the second edge back around toward the first edge such that the main body and the cap portion define a pocket therebetween for receiving the first leg.

16. An assembly as set forth in claim 15 wherein the first leg includes a first side facing the recess and a second side opposing the first side, and wherein the first leg includes a base facing away from the second component and disposed between the first and second sides such that the base and the first side present a first junction and the base and the second side present a second junction, with the second junction disposed in the pocket.

17. An assembly as set forth in claim 15 wherein the cap portion extends from the second edge back around toward the first edge to define an arcuate configuration.

18. An assembly as set forth in claim 1 wherein the distal end of the link defines a recess such that the distal end presents a first leg and a second leg spaced from each other, and further including a biasing member coupled to the first component and disposed in the recess of the link to continuously bias the second component to the second position, and wherein the guard includes a tab extending into the recess between the first and second legs and engaging the biasing member for securing the biasing member in the recess.

19. An assembly as set forth in claim 18 wherein the biasing member is further defined as a torsion rod including a first part attached to the first component and a second part secured in the recess by the tab.

20. A vehicle comprising:

a storage compartment including a mounting shelf and a trunk lid movable relative to the mounting shelf to open and close the storage compartment;

a hinge assembly coupled to the mounting shelf and the trunk lid for supporting the trunk lid when opening and closing the storage compartment, with the hinge assembly comprising:

a first component attached to the mounting shelf;

a second component coupled to the first component and attached to the trunk lid, with the second component pivotable relative to the first component;

a link movably coupled to the second component and extending away from the second component to a distal end; and a guard attached to the link and covering at least a portion of the distal end.

* * * * *